US005938040A

United States Patent [19]

Goodwin et al.

[11] Patent Number: 5,938,040

[45] Date of Patent: Aug. 17, 1999

[54] DISPLAY TRAY

[76] Inventors: David Malcolm Goodwin; Nicholas Mernor Hamnett, both of Barn House, Home Farm, Warren Lane, United Kingdom, GU22 8XD

[21] Appl. No.: 08/737,391

[22] PCT Filed: May 11, 1995

[86] PCT No.: PCT/GB95/01071

§ 371 Date: Feb. 5, 1997

§ 102(e) Date: Feb. 5, 1997

[87] PCT Pub. No.: WO95/31126

PCT Pub. Date: Nov. 23, 1995

[30] Foreign Application Priority Data

May 12, 1994 [GB] United Kingdom ..... 9409532

[51] Int. Cl.[6] ..... A45C 11/34

[52] U.S. Cl. ..... 206/756; 206/214; 206/224; 206/371; 206/443

[58] Field of Search ..... 211/71, 72, 89, 211/60.1, 69.1, 69.9; 206/371, 214, 224, 485, 443, 372, 373, 376, 377, 378, 477, 479, 480, 483, 561, 565

[56] References Cited

U.S. PATENT DOCUMENTS

| | | | |
|---|---|---|---|
| 531,799 | 1/1895 | Hunt | 206/214 |
| 539,720 | 5/1895 | Bischoff | 206/480 |
| 565,710 | 8/1896 | Tollner | 206/214 |
| 662,824 | 11/1900 | Rosher | 211/69.9 |
| 952,593 | 3/1910 | Wagner | 211/69.9 |
| 1,360,042 | 11/1920 | Srofe | 206/443 X |
| 2,649,191 | 8/1953 | McLaughlin | 206/373 |
| 3,554,429 | 1/1971 | Cohen | 206/561 X |
| 3,837,477 | 9/1974 | Boudreau | 206/376 X |
| 4,182,455 | 1/1980 | Zurawin | 211/71 |
| 4,341,308 | 7/1982 | Pasquini | 206/485 X |
| 4,705,168 | 11/1987 | Ward | 206/376 X |
| 5,215,726 | 6/1993 | Kudla et al. | 206/565 X |
| 5,505,316 | 4/1996 | Lee | 206/376 X |

FOREIGN PATENT DOCUMENTS

| | | |
|---|---|---|
| 1030005 | 3/1953 | France . |
| 900668 | 7/1949 | Germany . |
| 900 668 | 12/1951 | Germany . |
| 341404 | 4/1974 | Switzerland . |
| 2033740 | 5/1980 | United Kingdom . |

*Primary Examiner*—Jacob K. Ackun
*Attorney, Agent, or Firm*—David A. Howley

[57] ABSTRACT

A display device includes a generally planar upper surface. The upper surface has at least two upstanding walls, each wall having a profiled edge for receiving and supporting a generally cylindrical object. At least one of the walls is removable from the upper surface.

6 Claims, 5 Drawing Sheets

DISPLAY TRAY

The present invention relates to a display device.

Display devices for writing instruments, by means of which the writing instruments can be displayed in a shop for viewing by prospective purchasers, are often made of vacuum-formed recessed trays. The writing instruments are simply put into shallow elongate recesses in the trays which are often kept in drawers in a display cabinet in a shop. If a customer wishes to view the writing instruments, the trays will be moved as they are retrieved from the cabinet and presented to the customer. This can lead to damage of the surfaces of the writing instruments since they can slide about in the trays as the drawers in which the trays are stored are opened and closed and also when the trays are passed to the customer. In addition, these recessed trays are generally unattractive and have little scope for varying the display effect.

According to the present invention, there is provided a display device having a generally planar upper surface, the upper surface having at least two upstanding walls, each wall having a profiled edge for receiving and supporting a generally cylindrical object.

In this specification, reference will be made to the display device for displaying writing instruments in particular. However, it is to be understood that the device can be used for displaying other generally cylindrical objects.

The writing instruments can be laid across the upstanding walls to be supported by the walls.

The profiled edges of the walls preferably include a plurality of recesses, each recess being for receiving a cylindrical object. By providing a plurality of recesses, the writing instruments or other objects can be laid across the two walls generally at a right angle to the length of the walls, or at some other angle. This enables some flexibility in the display, for example, allowing the writing instruments or other objects to be fanned out across the display device.

At least one of the walls may be removable from the upper surface. Said at least one removable wall may be an elongate strip which is profiled on each of its opposed long edges. The profiles on the opposed long edges may differ from one another. This enables further variation in the display effect since a different pitch between adjacent writing instruments or other objects can be achieved according to which long edge is uppermost.

Preferably, the arrangement is such that a cylindrical object-is supported by the walls so as not to contact the upper surface. This has two main advantages. Firstly, the object is held away from the surface and is thus protected from damage by contact with the upper surface. Secondly, since the object is held out of contact with the surface, any display background can be used, thus allowing greater scope in the display effect which may be achieved.

The walls are preferably made of a material with a relatively high coefficient of friction. This prevents the objects from sliding around on the display device. For example, the walls may be made of polyvinylchloride (PVC).

An example of the present invention will be described with reference to the accompanying drawings, in which.

Figure 1:
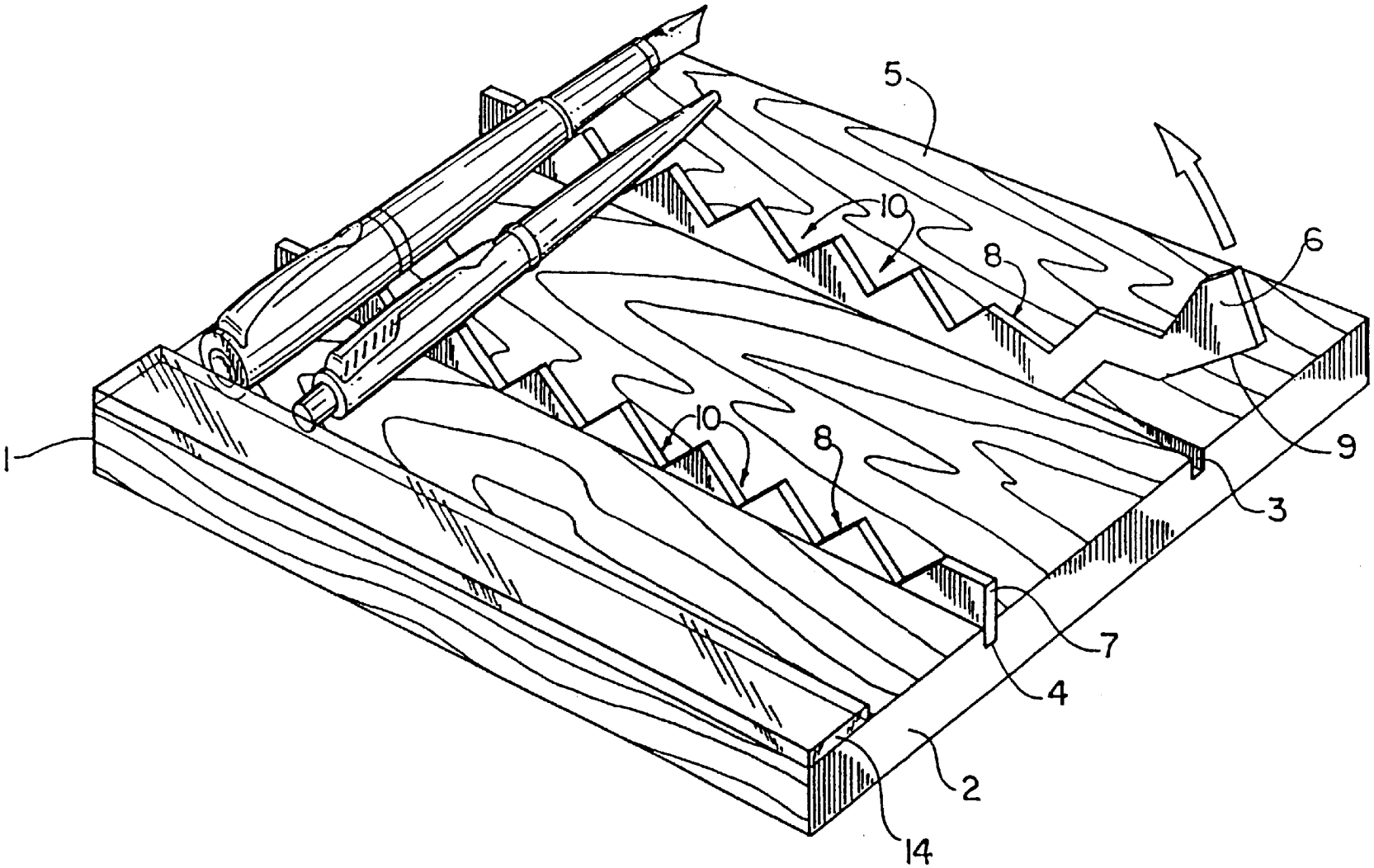
FIG. 1 is a perspective view of a first example of a display device.

A display device 1 has a generally rectangular or square base 2 in the form of a tile. The base 2 has a pair of parallel elongate grooves 3, 4 in its upper surface 5. The elongate grooves 3, 4 extend across the base and divide the upper surface 5 into three roughly equal portions.

A pair of elongate strips 6, 7 have a thickness which is substantially equal to the thickness of the respective grooves 3, 4 so that the strips 6, 7 can be snugly received in the respective grooves 3, 4 to form two upstanding walls.

Figure 7:
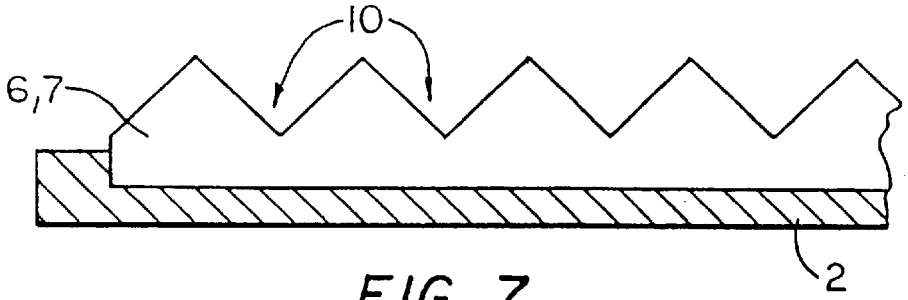
Figure 8:
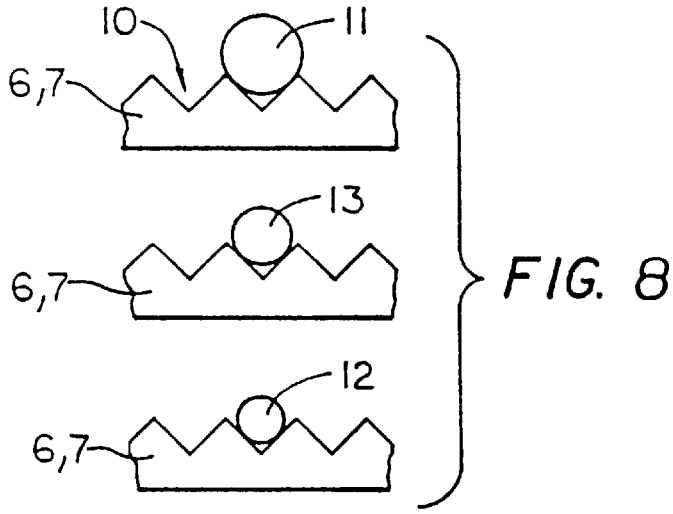
FIG. 8 shows writing instruments of different sizes being supported by a wall; and, FIG. 9 is an elevation of a wall having different profiles on its upper and lower edges.

Each strip 6, 7 has an upper long edge 8 and a lower long edge 9. At least the upper edge 8, and preferably also the lower edge 9, of each strip 6, 7 is profiled. In the example shown in FIG. 1 and FIG. 7, the profiling is in the form of a sawtooth which defines a plurality of triangular recesses 10 along the upper edge 8 of the strip 6, 7. As can be seen in FIG. 8, the triangular recesses 10 can easily accommodate relatively large diameter writing instruments 11 or relatively small diameter writing instruments 12 or intermediate size writing instruments 13.

Figure 4:
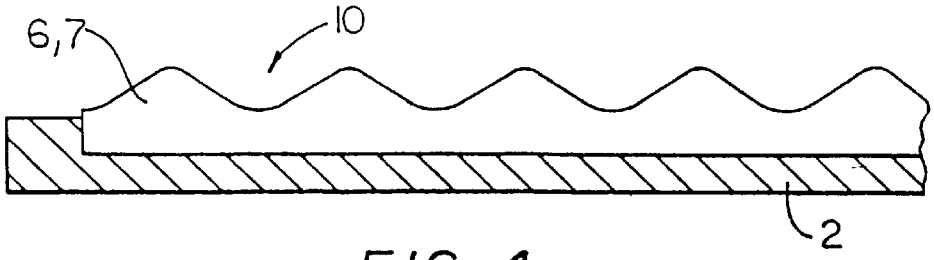
FIGS. 4 to 7 are partial elevations of walls and cross-sections through the display device showing examples of profiles of the walls.
Figure 5:
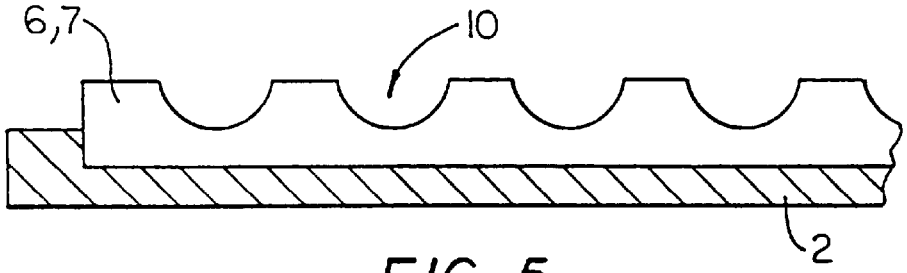
Figure 6:
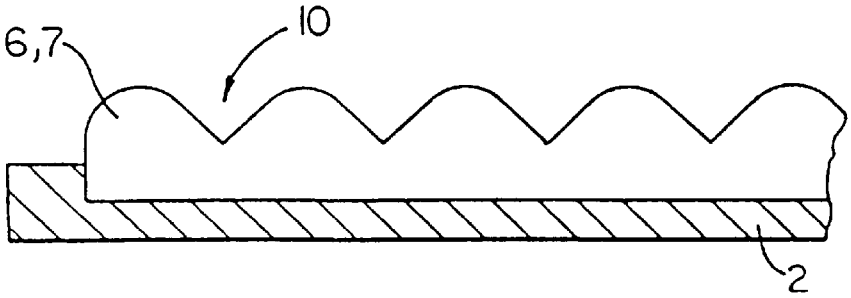

Examples of different profiles for the strip 6, 7 are shown in FIGS. 4 to 6, each profiling providing recesses 10 which can receive writing instruments, which may be of different sizes as in FIG. 8.

Figure 9:
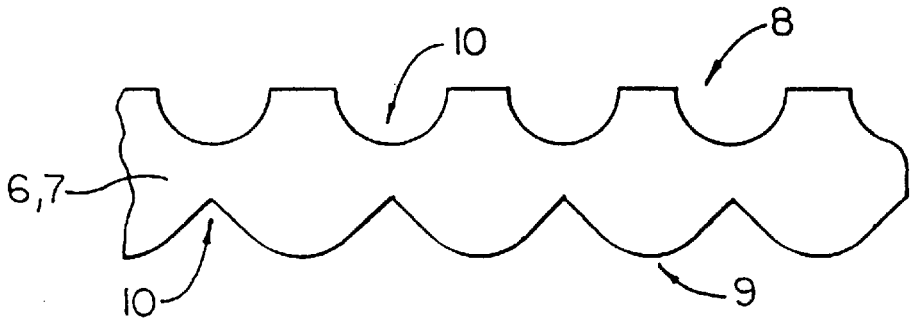

Both the upper and lower edges 8, 9 of the strips 6, 7 may be profiled. The profiling on the respective upper and lower edges 8, 9 may be different as shown in FIG. 9. The pitch between adjacent recesses 10 may differ between the upper and lower edges 8, 9 to provide different spacing between adjacent writing instruments 11 or other objects displayed on the device 1. Alternatively or additionally, the recesses 10 may be relatively deeper on the lower edge 9 compared to the upper edge 8 of the strips 6, 7 to accommodate a greater range of size of writing instruments 11.

The strips 6, 7 are preferably made of a material having a relatively high coefficient of friction, such as polyvinylchloride (PVC), a thermoplastic elastomer, or natural or synthetic rubber, so that the writing instruments 11 are gripped firmly and are less prone to sliding off the strips 6 when the device 1 is moved.

A supporting ridge 14 may be provided along one edge of the base 2 parallel to the strips 6, 7, the supporting ridge 14 standing proud of the upper surface 5. This provides a backstop against which the writing instruments 11 may rest. The recesses 10 of the strip 6 furthest away from this supporting ridge 14 may be relatively higher than the strip 7 which is relatively nearer the ridge 14 so that the writing instruments 11 are inclined slightly backwards to the ridge 14.

Figure 2:
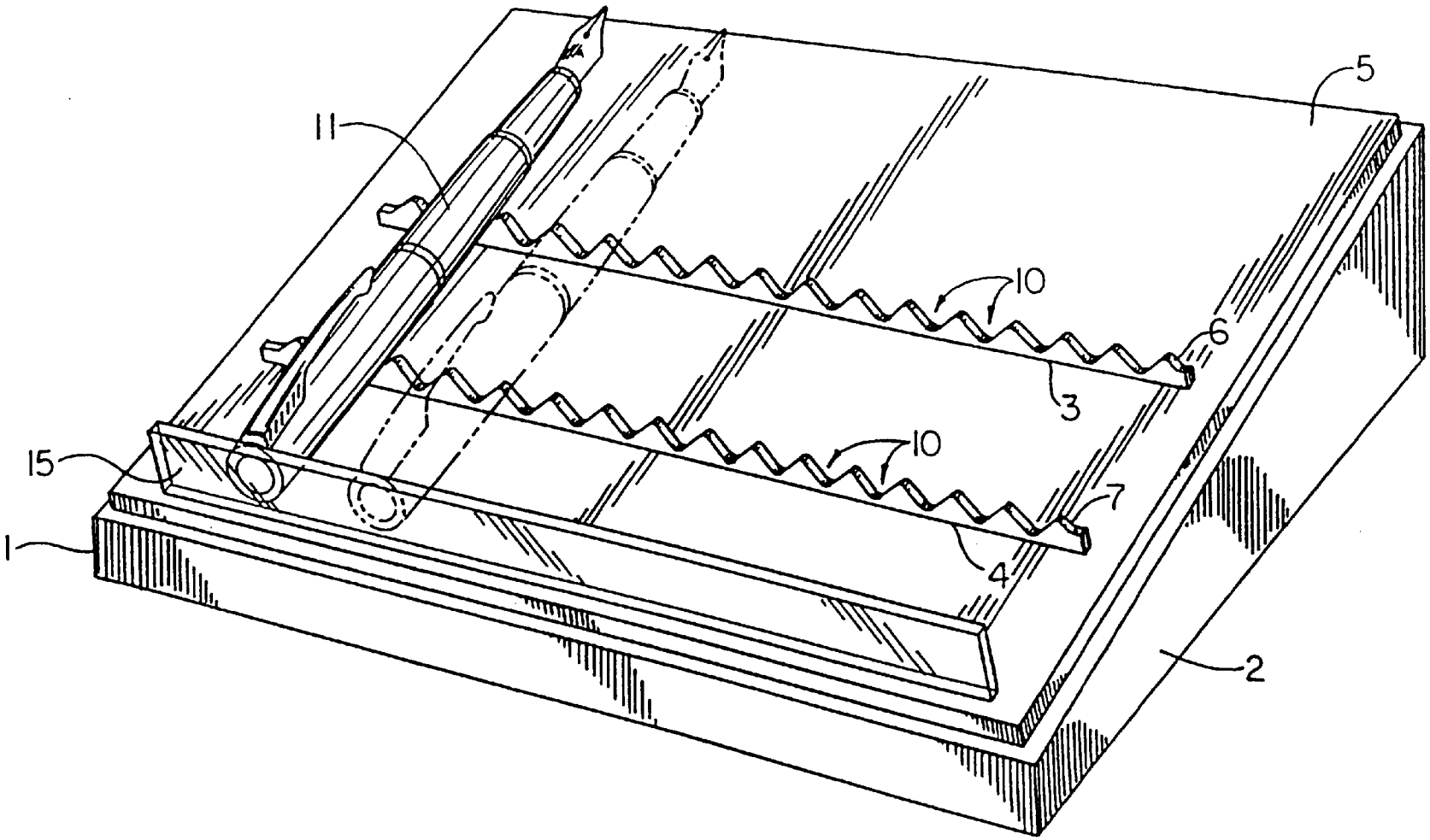
FIG. 2 is a perspective view of a second example of a display device.
Figure 3:
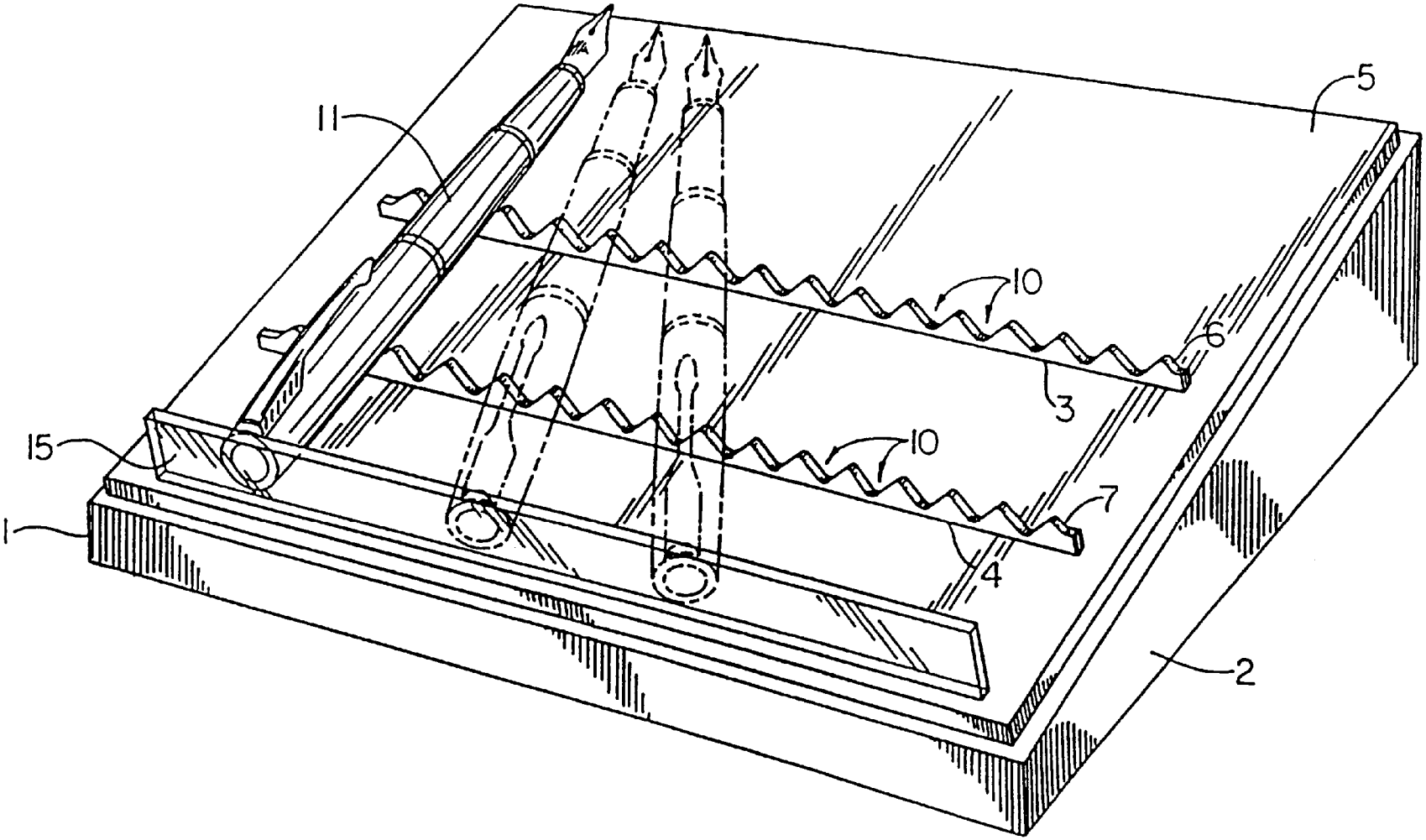
FIG. 3 is a perspective view of the display device of FIG. 2 with writing instruments in a "fanned" orientation.

A second example of a display device is shown in FIGS. 2 and 3. In this example, the base 2 is wedge-shaped as shown so that the writing instruments 11 tilt backwards. Also, instead of the ridge 14 of the example of FIG. 1, a clear plastics wall 15 is provided as the backstop to support the rear of the writing instruments 11.

In FIGS. 1 and 2, the writing instruments 11 are shown generally parallel to the side edges of the base 2. The writing instruments 11 may alternatively be fanned across the device 1 as shown in FIG. 3. This may be achieved by using one strip 6 in which the recesses are spaced having a relatively small pitch and a second strip 7 in which the recesses 10 have a relatively greater pitch, the writing instruments 11 then being placed in adjacent recesses 10. Alternatively, as shown, the upper part of each writing instrument 11 can simply be placed in alternate recesses 10 in one of the strips 7 where the two strips 6, 7 have the same or substantially the same spacing between recesses 10.

It will be seen that the writing instruments 11 are supported by the strips 6 so as not to contact the upper surface 5, simply by arranging that the lower portions of the recesses 10 are sufficiently clear of the upper surface 5. This means that any material can be used for the upper surface 5. This in turn means that there is no restriction on the background which may be applied to the upper surface 5, thus giving free choice to the display effect to be achieved. For example, the upper surface 5 may be made of wood, metal, stone, plastics, etc. The upper surface 5 may be detachably clipped to the base 2 so that different display backgrounds for the upper surface 5 can be used interchangeably.

It will be appreciated that more than two walls 6 may be used if required, though for supporting writing instruments, it is believed that two walls 6, 7 would be sufficient.

The undersurface of the base 2 may have recesses or protuberances which enable it to be stacked on top of other tiles or some other support. This enables adjacent display devices 1 to be displayed at different heights in a showcase, which enhances the attractiveness of the overall display.

We claim:

1. A display device having a generally planar upper surface, the upper surface having at least two upstanding walls, each wall having a profiled edge for receiving and supporting a generally cylindrical object, at least one of the walls being removable from the upper surface, wherein said at least one removable wall is an elongated strip which is profiled on each of its opposed long edges.

2. A display device according to claim 1, wherein the profiled edges of the walls include a plurality of recesses, each recess being for receiving a cylindrical object.

3. A display device according to claim 1, wherein the profiles on the opposed long edges differ from one another.

4. A display device according to claim 1, wherein the profiled edges of the walls are profiled such that a generally cylindrical object supported on the edges will not contact the upper surface.

5. A display device according to claim 1, wherein the walls are made of a material with a relatively high coefficient of friction.

6. A display device according to claim 5, wherein the walls are made of polyvinylchloride (PVC), a thermoplastic elastomer, natural rubber or synthetic rubber.

* * * * *